United States Patent [19]

Fenton

[11] Patent Number: 4,974,846

[45] Date of Patent: Dec. 4, 1990

[54] GOLF CLUB GRIP

[75] Inventor: Frank Fenton, South Hadley, Mass.

[73] Assignee: Spalding & Evenflo Companies, Inc., Tampa, Fla.

[21] Appl. No.: 335,334

[22] Filed: Apr. 10, 1989

[51] Int. Cl.[5] ..... A63B 53/14

[52] U.S. Cl. ..... 273/81 B; 273/81.6

[58] Field of Search ..... 273/81 R, 81 B, 81.4, 273/81.5, 81.6, 67 DB, 75, 81 D, 165; D21/222; 16/DIG. 12, 111 R; D8/303

[56] References Cited

U.S. PATENT DOCUMENTS

| | | | |
|---|---|---|---|
| D. 212,103 | 8/1968 | Myers | D21/222 |
| D. 223,461 | 4/1972 | Spencer | D21/222 |
| D. 223,459 | 4/1972 | Spencer | D21/222 |
| D. 223,462 | 4/1972 | Spencer | D21/222 |
| D. 228,198 | 8/1973 | Spencer | D21/222 |
| D. 235,899 | 7/1975 | Spencer | D21/222 |
| D. 235,900 | 7/1975 | Spencer | D21/222 |
| D. 238,381 | 1/1976 | Spencer | D21/222 |
| D. 243,355 | 2/1977 | Spencer | D21/222 |
| D. 244,100 | 4/1977 | Spencer | D21/222 |
| D. 245,797 | 9/1977 | Hollendorfer | D21/222 |
| D. 259,802 | 7/1981 | Williams | D21/222 |
| D. 268,944 | 5/1983 | Southey | D21/222 |
| D. 281,991 | 12/1985 | Solheim | D21/222 |
| D. 284,298 | 6/1986 | Kobayashi | D21/222 |
| D. 290,730 | 7/1987 | Solheim | D21/222 |
| 1,587,082 | 6/1926 | Mattern | 273/81 R |
| 2,115,119 | 4/1938 | Park | 273/81 R |
| 2,446,622 | 8/1948 | Turner | 16/DIG. 12 X |

FOREIGN PATENT DOCUMENTS

| | | | |
|---|---|---|---|
| 156538 | 5/1954 | Australia | 273/81 B |

*Primary Examiner*—Edward M. Coven
*Assistant Examiner*—Sebastiano Passaniti
*Attorney, Agent, or Firm*—Donald R. Bahr

[57] ABSTRACT

An improved golf club comprising a shaft with a head at the tip end and a grip at the butt end, the grip adapted to be held by the hands of the player and formed of an elastomeric material having a plurality of curved grooves, the grooves being in a first set oriented generally axially at the butt end of the grip and therebeyond in a second set generally axially on the bottom surface and generally circumferentially on the top surface and further including a third set of grooves oriented generally circumferentially at the tip end of the grip.

8 Claims, 4 Drawing Sheets

GOLF CLUB GRIP

BACKGROUND OF THE INVENTION

This invention relates to improved golf club grips and, more particularly, to an improved golf club grip with generally circumferential and generally axial grooves for abating slippage of the grip and club with respect to the player's hand.

DESCRIPTION OF THE BACKGROUND ART

In the game of golf, a player holds a club at the upper or butt end and swings it so that the head at the lower or tip end hits the ball to propel it toward the hole. The game of golf has been played for hundreds of years and has produced numerous technical advancements in the ball, the golf course, and the club in an effort to lower scores and add to the enjoyment of the game. One area of particular importance is the golf club grip, the region of contact between the player and the club.

A large number of grip improvements relate to the materials. Grips have been made of natural materials such as leather and rubber as well as a wide variety of synthetic materials. Synthetic materials, generally elastomers, are finding increased popularity due to the ability of scientists to design in the properties for enhancing comfort, grippability and resistance to slippage with respect to the player's hands. The most perfect of swings will yield disastrous results if the club inadvertently slides in the hands of the player. Advancements in materials include properly engineered compressability to promote comfort of the user's hands when properly positioned. Such feature aids in proper hand placement but only somewhat in abating slippage. In addition to improvements in the materials of golf club grips, advancements have also been made in indicia on the surface of the club to verify proper hand placement. Such indicia, however, does not abate club slippage during a swing.

Mechanical advancements have also been made to promote proper club placement and to abate slippage. In some grips, material projects outwardly to effect a better mechanical coupling between hand and grip. Conversely, randomly placed grooves can also promote a beneficial mechanical coupling. Mechanical coupling is promoted by either scheme, but in no instance is it known where mechanical irregularities of the grip's surface has been strategically located wth anti-slippage radii for maximizing the effect of slippage abatement.

While these prior art approaches as discussed above, as well as approaches in the prior art patents referred to in the Information Disclosure Statement of this application, describe advantages in golf club grip constructions, none discloses the construction by which applicant's invention may be utilized to optimize coupling of a player's hands to the grip for promoting lower scores and greater enjoyment during a game of golf.

Although many such prior advancements are noteworthy to one extent or another, none achieves the objectives of an efficient, reliable, inexpensive, convenient to use golf grip designed to accommodate the needs of a wide variety of players.

As illustrated by a great number of known techniques and prior patents, efforts are continuously being made in an attempt to improve golf grips and render their use more efficient, convenient, reliable and economical. None of these previous efforts, however, provides the benefits attendant with the present invention. Additionally, prior techniques do not suggest the present inventive combination of component elements as disclosed and claimed herein. The present invention achieves its intended purposes, objectives and advantages over the prior art devices through a new, useful and unobvious golf grip which is simple to use, with the utilization of a minimum number of component parts, at a reasonable cost to manufacture, and by employing only readily available materials.

Therefore, it is an object of this invention to provide an improved golf club grip formed of an elastomeric material and having a plurality of grooves, the grooves being oriented generally axially at the butt end of the grip and, therebeyond, generally axially on the bottom surface and generally circumferentially on the top surface in all cases having the grooves radiused to stop the slippage of the golfer's hands during the swing.

It is a further object of the present invention to abate slippage of a golf club in a player's hands during a swing.

It is yet a further object of the present invention to increase the mechanical coupling of a golfer's hands to the golf club grip.

Lastly, it is an object of the present invention to lower the scores and increase the enjoyment of golfers.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into an improved grip positionable over the butt end of a golf club shaft and adapted to be held by the hands of a player. The grip is fabricated of an elastomeric material and of a generally cylindrical configuration with a generally closed butt end of an enlarged exterior diameter and with an open tip end of a generally reduced exterior diameter for being removably fit over the butt end of the shaft. The interior of the grip is of an essentially common diameter with dimensions changing only for frictional engagement with the butt end of the shaft over which it is placed, the exterior diameter of the grip being of a decreasing diameter from the butt end to the tip end, the grip being formed with a plurality of grooves. The grooves are oriented generally axially over the length of the grip adjacent to the butt end for between about 26 percent to about 31 percent of the length of the grip. The grooves are oriented generally circumferentially over the length of the grip adjacent the tip end for about 19.5 to about 23.5 percent of the length of the grip with between about 38.5 percent and about 47.5 percent of the central length of the grip having generally circumferential grooves on its top surface and generally axial grooves on its bottom surface. The grooves are about 0.025 inches in depth and about 0.030 inches in width. The majority of the grooves are spaced between about 0.220 and about 0.240 inches from center to center. The grooves are spiral in one direction or the other to prevent slippage of the golfer's.

The invention may also be incorporated into an improved golf grip formed of an elastomeric material having a plurality of grooves, the grooves being in a first set oriented generally axially at the butt end of the grip and therebeyond in a second set generally axially on the bottom surface and generally circumferentially on the top surface. The grooves of the first set extend about 3 inches from the butt end, plus or minus ten percent (10%). The grooves of the second set extend about 4½ inches from the first set. The golf grip further includes a third set of groove oriented generally circumferentially at the tip end of the grip.

Lastly, the invention may be incorporated into an improved golf club comprising a shaft with a head at the tip end and a grip at the butt end. The grip is adapted to be held by the hands of the player. It is formed of an elastomeric material having a plurality of grooves. The grooves are in a first set oriented generally axially at the butt end of the grip and therebeyond in a second set generally axially on the bottom surface and generally circumferentially on the top surface and further including a third set of grooves oriented generally circumferentially at the tip end of the grip.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

Similar referenced characters refer to similar parts throughout the several Figures.

DETAILED DESCRIPTION OF THE INVENTION

Figure 1:
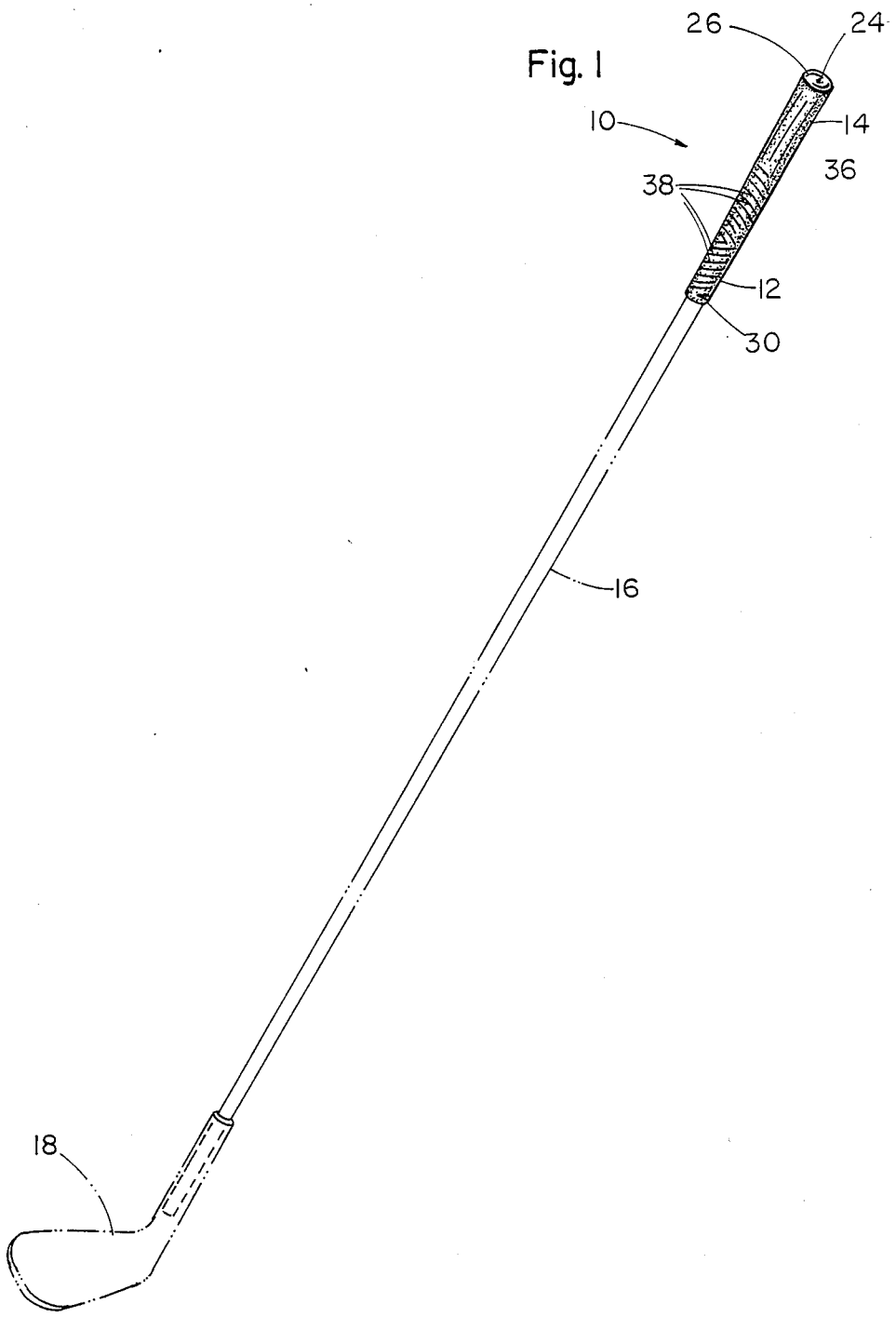
FIG. 1 is a perspective illustration of a golf club employing the grip of the present invention.

Shown in the Figures is a golf club 10, with a golf club grip 12 constructed in accordance with the principles of the present invention. The grip is positionable over the upper or butt end 14 of a golf club shaft 16. The head 18 is positioned at the opposite, lower or tip end of the shaft. The grip 12 is adapted to be held by the hands 20 and 22 of a player. It is a fabricated of an elastomeric material such as a synthetic rubber with particulate cork for increased frictional coupling between the grip 12 and a player's hands 20 and 22.

The grip 12 is shaped in a generally cylindrical configuration with a butt end 26 generally closed by a rigid cap 28 having a breathing aperture 24. The butt end 26 is of an enlarged exterior diameter while the tip end 30 is of a generally reduced exterior diameter. The tip end 30 has an opening 32 for being fit over the butt end 14 of the shaft 16. The interior diameter of the grip 12 is of an essentially common diameter with only slight diameter changes for frictionally engaging the common diameter of the butt end 14 of the shaft 16 over which it is placed. The exterior diameter of the grip 12 is of a decreasing diameter from the butt end 14 to the tip end 30.

The grip 12 is formed with a plurality of grooves 36 and 38. The grooves 36 of the upper extent 40 are generally oriented axially over the length of the grip 12 adjacent to the butt end 14 for about 3 inches of a 10½ inch grip between 26 percent to about 31 percent of the length of the grip. The grooves 38 of the lower extent 42 are configured generally circumferentially adjacent the tip end for about 2½ inches or about 19.5 to about 23.5 percent of the length of the grip. Between about 38.5 percent and 47.5 percent of the central extent 44 of the grip, about 4½ inches, has generally circumferential grooves 38 on its top surface and generally axial grooves on its bottom surface. A logo 48 or other indicia is located on the top surface for placement purposes.

The grooves are about 0.025 inches in depth and about 0.030 inches across in width. A variation of about plus or minus ten percent (10%) has been found acceptable. The majority of the grooves are spaced from center to center about 0.220 inches axially and 0.240 circumferentially. Again, variations of about plus or minus ten percent (10%) has been found acceptable.

Figure 2:
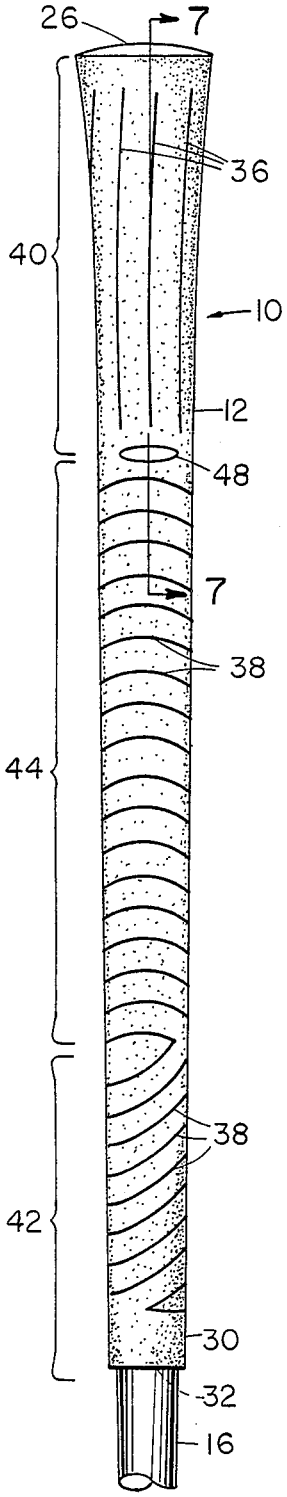
FIG. 2 is a plan view of the golf grip shown in FIG. 1.
Figure 3:
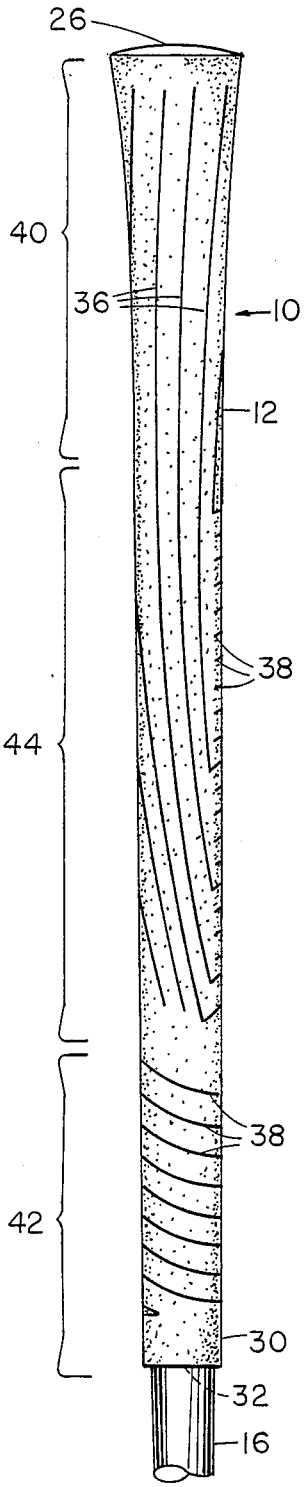
FIG. 3 is a right side elevational view of the golf grip shown in FIGS. 1 and 2
Figure 4:
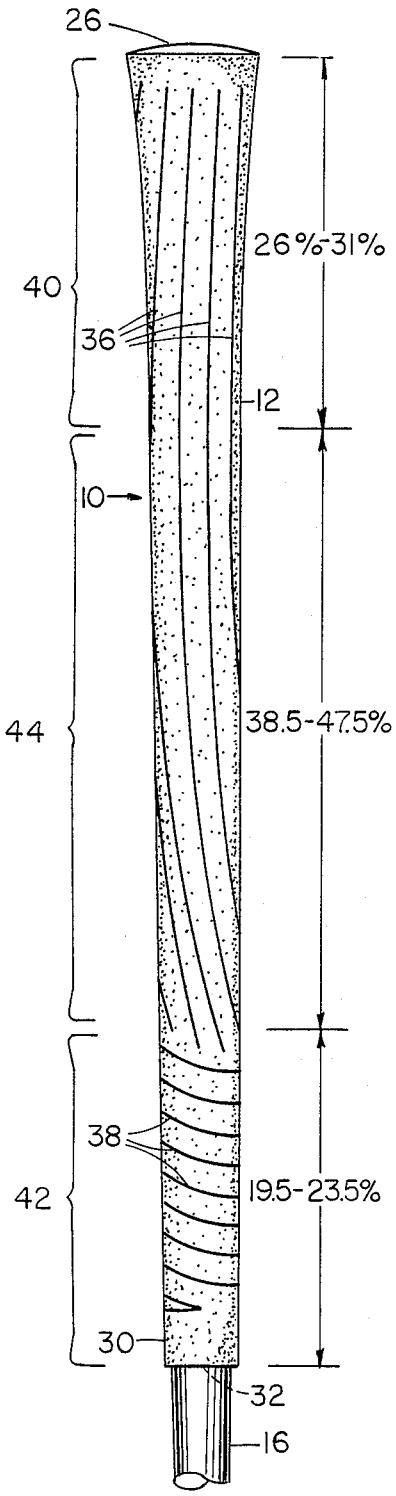
FIG. 4 is a bottom side elevational view of the golf grip shown in FIGS. 1, 2 and 3.

As can be seen in the various Figures, the generally axial grooves 36 are not totally axial with respect to the axis of the shaft and grip. Similarly, the generally circumferential grooves 38 are not totally circumferential with respect thereto. Rather, both the longitudinal and circumferential grooves are slightly radiused or curved, spiraling in one direction or the other. As can be seen best in FIG. 2, the generally circumferential grooves 38 in the central extent 44 spiral downwardly toward the tip end a their edges. Conversely, the grooves 38 of the lower extent 42 adjacent the tip end of the grip spiral upwardly away from the tip end 30 toward the butt end 26 of the grip 12. Further, the grooves 36 at the butt end 26 are generally axial around the entire circumference of the grip 12 while the grooves 38 adjacent to the tip end 30 are generally circumferential around the entire circumference of the grip 12. The grooves in the central extent 44, between the upper and lower extents 40 and 42, are a combination of circumferential grooves 38 over the entire front surface of the central extent 44 as shown in FIG. 2. By extrapolating FIGS. 3 and 4, it can be seen that the bottom surface of the grip 12 is entirely composed of axial grooves 36 which are extensions of the grooves 36 of the upper extent 40. The grip is oriented on the club shaft such that the front surface is engaged predominantly by both the heel of one hand of a golfer and the inner surface of the thumb of another hand of the golfer and the bottom surface is engaged predominantly by the inner surfaces of the remaining fingers of each of the hands during the address of the golf ball.

The type of groove, its depth and width as well as spacings from centerline to centerline of adjacent grooves are all essentially as shown. Minor variations are acceptable. The particular location and spiraling of the grooves is the result of a study of the action of the hands of numerous golfers during their golf swings.

Figure 5:
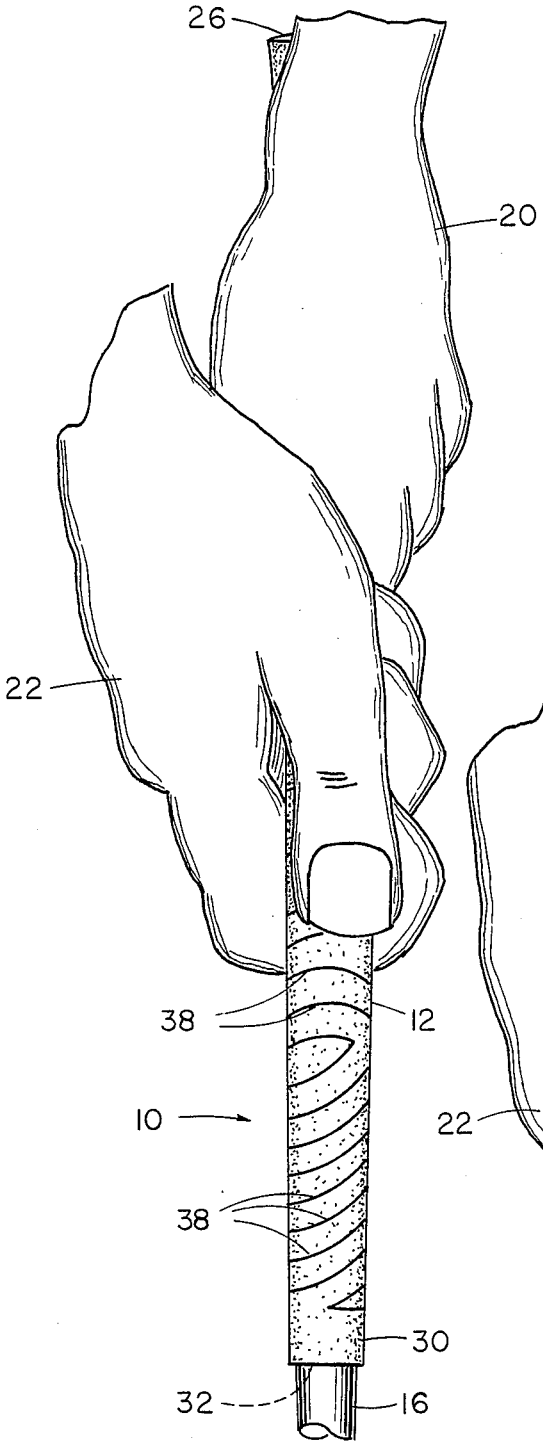
FIG. 5 is a plan view of the golf club grip shown in FIG. 1 being held in a normal position by a player.
Figure 6:
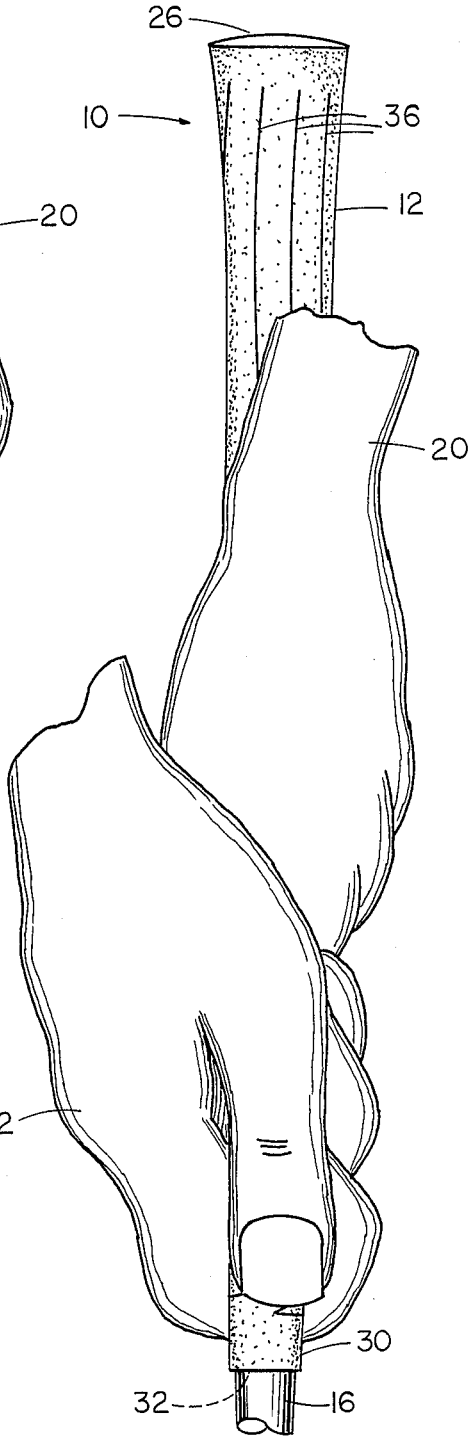
FIG. 6 is a plan view similar to FIG. 5 but illustrating the golfer holding the golf club grip at a lower extent for a shorter shot.
Figure 7:
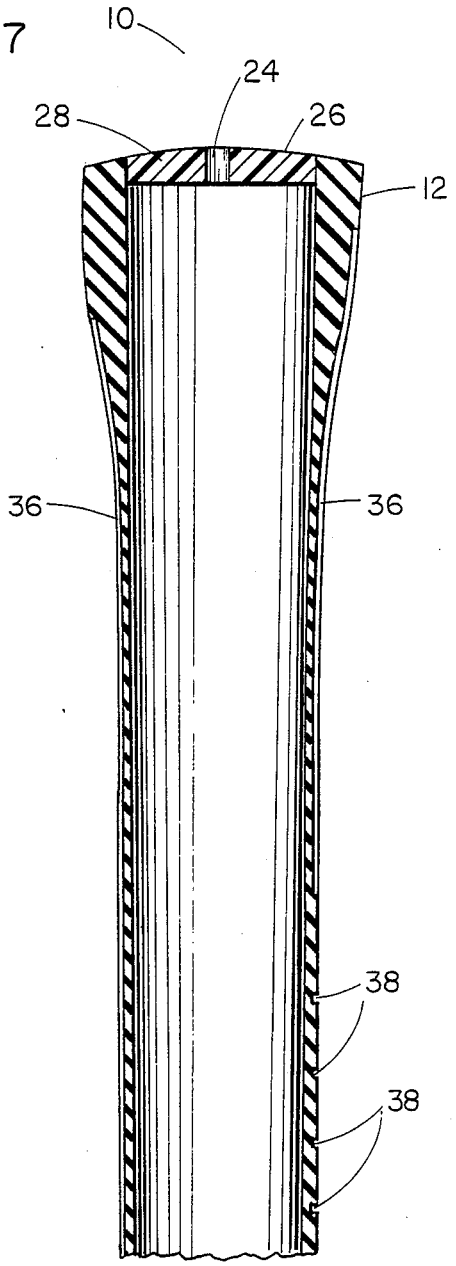
FIG. 7 is a sectional view of the golf grip shown in FIGS. 1, 2, 3 and 4 taken along line 7—7 of FIG. 1.

As shown in FIGS. 5 and 6, with the heel of the left hand 20 over the axial groove 36 on the top surface at the butt end 26 of the grip, the left thumb extends down onto the generally circumferential grooves 38 in the central extent 44. The third and fourth fingers of the right hand 22 are on the bottom surface of the grip in the central extent 44 overlying the axial grooves 36. The thumb of the right hand 22 extends downwardly over the circumferential grooves 38 of the central extent 44.

These grooves all correlated with the proper hand position and have been analyzed through tests in an effort to abate improper slippage of the hands with respect to the grip 12 and shaft 16 or the grip and shaft with respect to the hands 20 and 22 as caused by perspiration, impact of the club head 18, a torquing of the shaft 16 around its axis, etc. The generally circumferential grooves 38 preclude axial movement of hands thereadjacent while the axial grooves 36 preclude circumferential rotational movement between hands and grip. This is effected since the flesh of the hands will extend into the various grooves to make a mechanical bonding or coupling therebetween. When used with a resilient material of the grip itself, the comfort attendant with normal elastomeric grips is maintained for a most efficient and comfortable coupling of hands and grip.

The particular spiraling of the various grooves is to effect retention of the hand flesh with the grooves. The flesh of the hands not only tends to move axially and circumferentially with respect to the grip but slightly at an angle with respect thereto. This tendency is counteracted via the spiraling effect of the grooves which is perpendicular to the forces of the hands against the grip.

FIG. 6 illustrates the hands when placed in a lower position down on the grip and shaft, a choking of the club. This is frequently used in more delicate chip shots or golf shots with less than a full swing. It has been found that the forces of the hand during swinging with a choked grip are slightly different than those during a normal full swing when holding the club as in FIG. 5. The particular circumferential orientation of the grooves 38 adjacent to the tip end 30 of the club 10 is to accommodate the variation in swing when the grip is held choked.

As shown in the various Figures, the grip 12 is adapted for a right-handed golfer. It should be appreciated that a mirror image of the grooves is preferably utilized for grips for use by left-handed golfers.

The herein described golf club grip may be used with any golf club shaft. Superior results are realized during use. Particularly superior results are realized when the herein described golf club grip is used with golf clubs having the light-weight golf club shafts as set forth in my co-pending U.S. patent application Ser. No. 07/335,335 (Attorney Docket P3025) filed concurrently herewith.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described.

What is claimed is:

1. A grip positionable over the butt end of a golf club shaft and adapted to be held by the hands of a golfer, the grip having a front surface and a bottom surface oriented on the club shaft such that said front surface is engaged predominantly by both the heel of one hand of the golfer and the inner surface of the thumb of another hand of the golfer and said bottom surface is engaged predominantly by the inner surfaces of the remaining fingers of each of the hands during the address of the golf ball, the grip being fabricated of an elastomeric material and of a generally cylindrical configuration with a generally closed butt end of an enlarged exterior diameter and with an open tip end of a generally reduced exterior diameter for being removably fit over the butt end of the shaft, the interior of the grip being of an essentially common diameter for frictional engagement with the butt end of the shaft over which it is placed, the exterior diameter of the grip being of a decreasing diameter from the butt end to the tip end, the grip being formed with a plurality of smoothly curved, generally continuous grooves oriented to prevent slippage, the grooves being oriented generally axially over the length of the grip adjacent to the butt end for between about 26 percent and about 31 percent of the length of the grip, the grooves being oriented generally circumferentially over the length of the grip adjacent the tip end for between about 19.5 and about 23.5 percent of the length of the grip with between about 38.5 percent and about 47.5 percent of the central length of the grip having generally circumferential grooves on its front surface and generally axial grooves on its bottom surface, said generally circumferential grooves across the central length being curved with their centers of curvature facing the tip end side of the grip.

2. The grip as set forth in claim 1 wherein the grooves are about 0.025 inches in depth and about 0.030 inches in width.

3. The grip as set forth in claim 2 wherein the majority of the grooves are spaced between about 0.220 and about 0.240 inches from center to center.

4. A golf grip adapted to be placed on a club shaft and held by the hands of a golfer, the grip having a front surface and a bottom surface oriented on the club shaft such that said front surface is engaged predominantly by both the heel of one hand of the golfer and the inner surface of the thumb of another hand of the golfer and said bottom surface is engaged predominantly by the inner surfaces of the remaining fingers of each of the hands during the address of the golf ball, the grip having a butt end and a tip end and formed of an elastomeric material having a plurality of smoothly curved continuous grooves, the grooves being in a first set oriented generally axially at the butt end of the grip and therebeyond in a second set generally axially on the bottom surface and generally circumferentially on the front surface, the circumferential grooves being curved with their centers of curvature facing the tip end side of the grip whereby said circumferential grooves serve to substantially preclude axial movement of said hands thereadjacent while said generally axial grooves serve to substantially preclude circumferential movement between said hands and said grip during a stroke of a golf ball.

5. The golf grip as set forth in claim 4 wherein the grooves of the first set extend axially about 3 inches from the butt end, plus or minus ten percent (10%).

6. The golf grip as set forth in claim 4 wherein the grooves of the second set extend about 4½ inches from the termination point of the first set.

7. The golf grip as set forth in claim 4 and further including a third set of grooves oriented generally circumferentially at the tip end of the grip.

8. A golf club comprising a shaft with a head at a tip end and a grip at a butt end, the grip adapted to be held by the hands of a golfer, the grip having a front surface and a bottom surface oriented on the club shaft such that said front surface is engaged predominantly by both the heel of one hand of the golfer and the inner surface of the thumb of another hand of the golfer and said bottom surface is engaged predominantly by the inner surfaces of the remaining fingers of each of the hands during the address of the golf ball, the grip being formed of an elastomeric material having a plurality of smoothly curved, continuous grooves, the grooves being in a first set oriented generally axially at the butt end of the grip and, therebeyond, in a second set generally axially on the bottom surface and generally circumferentially on the front surface, the circumferential grooves of the second set being curved with their centers of curvature facing the tip end side of the grip and further including a third set of grooves oriented generally circumferentially at the tip end of the grip, whereby the circumferential grooves serve to substantially preclude axial movement of said hands thereadjacent while said generally axial grooves serve to substantially preclude circumferential movement between said hands and said grip during a stroke of a golf ball.

* * * * *